US006001024A

United States Patent [19]

Van Alen, II et al.

[11] Patent Number: 6,001,024

[45] **Date of Patent: *Dec. 14, 1999**

[54] ADJUSTABLE GOLF PUTTER

[75] Inventors: James L. Van Alen, II; Robert B. Van Alen; Jeanne B. Van Alen; James L. Van Alen, Jr., all of Newtown Square, Pa.; Alexander Van Alen, Fort Collins, Colo.

[73] Assignee: Arrowhead Innovations Corporation, Newtown Square, Pa.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/941,521

[22] Filed: Sep. 30, 1997

Related U.S. Application Data

[63] Continuation-in-part of application No. 08/714,473, Sep. 16, 1996, Pat. No. 5,749,790.

[51] Int. Cl.[6] ..... A63B 53/06

[52] U.S. Cl. ..... 473/244; 473/313; 473/314; 473/341; 473/336

[58] Field of Search ..... 473/244, 245, 473/246, 247, 248, 313, 314, 336, 340, 341

[56] References Cited

U.S. PATENT DOCUMENTS

| | | | |
|---|---|---|---|
| 2,155,830 | 4/1939 | Howard | 473/246 |
| 2,932,515 | 4/1960 | May | 473/248 |
| 4,736,951 | 4/1988 | Grant | 473/246 |
| 5,470,063 | 11/1995 | Fisher | 473/248 |

*Primary Examiner*—Jeanette Chapman
*Assistant Examiner*—Stephen L. Blau
*Attorney, Agent, or Firm*—Joseph M. Konieczny; John F.A. Earley; Harding, Earley, Follmer & Frailey

[57] ABSTRACT

An adjustable golf club having means for adjusting the balance of the club and means for adjusting the alignment angle of the club. A club head is attached to the connection end of the shaft by connecting means at a connection point along the heel-to-toe axis and at a line-of-play alignment angle and a heel-to-toe alignment angle. The connecting means includes a slide fixed to the connection end of the shaft and a socket in the top portion of the club head. The balance of the club can be adjusted by linearly moving the slide along the heel-to-toe axis in the socket. The line-of-play alignment angle of the shaft can be adjusted by rotatably moving the slide in the socket. After the club is adjusted, the slide is secured in the socket by locking means to prevent the club from deviating from the desired adjusted configuration during play. A method of putting a golf ball with the above provided adjustable putter. The adjustable putter is provided to the golfer. The golfer adjusts the balance and line-of-play alignment angle of the club to the golfer's satisfaction. The golfer then strikes the golf ball with the adjusted putter.

32 Claims, 7 Drawing Sheets

ADJUSTABLE GOLF PUTTER

This is a continuation-in-part application of application Ser. No. 08/714,473 filed Sep. 16, 1996, now U.S. Pat. No. 5,749,790.

FIELD OF THE INVENTION

The present invention relates to an adjustable golf club, and more particularly, an adjustable golf putter having means for adjusting the balance of the club head and means for adjusting the alignment angle of the shaft.

BACKGROUND OF THE INVENTION

A golf club has many design features such as the size, weight, and shape of the head, and the rigidity, straightness, length and alignment of the shaft. Golfers often switch golf clubs, in particular the putter, to better suit their physical characteristics or swing technique. While many commercial brands of standard golf clubs are available having different design characteristics, changing golf clubs frequently is expensive.

Some adjustable golf clubs are known. However, under current United States Golf Association (U.S.G.A.) Rule 4-1a(i), only putters may be designed to be adjustable, except for weight, provided that all configurations of adjustment conform with the Rules. Phillips U.S. Pat. No. 5,348,295 and Jarvis U.S. Pat. No. 4,569,523 each appear to disclose a golf putter with a shaft which may be adjusted about a pivot to change the "heel-to-toe" alignment and/or the "line-of-play" alignment of the shaft. As used herein, the "heel-to-toe" alignment and "line-of-play" alignment are defined consistent with the U.S.G.A. Rules of Golf 1996, Appendix II, rule 4.1b, Figs. II and III, as follows: "heel-to-toe" alignment is the projection of the straight part of the shaft on to the vertical plane through the toe and heel; "line-of-play" alignment is the projection of the straight part of the shaft on to the vertical plane along the intended line of play.

Under U.S.G.A. rule 4.1b, the "heel-to-toe" alignment must be at least 10 degrees from vertical and the "line-of-play" alignment must be no greater than 20 degrees from vertical in either direction. Since the above-described adjustable putters may be adjusted into configurations of alignment different than those proscribed in U.S.G.A. rule 4.1b, such known adjustable putters do not conform with U.S.G.A. rules and are therefore illegal in U.S.G.A. sponsored competition. Therefore, it would be desirable to provide a putter having a shaft alignment which may be adjusted only within the ranges proscribed by the U.S.G.A. rules.

Further, no known adjustable golf putters provide both shaft alignment adjustment and adjustment or movement of the connection point between the shaft and the club head along the heel-to-toe axis. Movement of the connection point between the shaft and the club head along the heel-to-toe axis adjusts the "balance" of the club. Therefore, it would also be desirable to provide a putter having "alignment" as well as "balance" adjustment.

Additionally, under U.S.G.A. Rules 4-1a(i) and (ii), a putter may be adjustable provided that the adjustment cannot be readily made and that all adjustable parts are firmly fixed and there is no reasonable likelihood of them working loose during a round. Therefore, it would also be desirable to provide a putter having the aforementioned adjustability but which also complies with all U.S.G.A. rules relating the design of clubs.

SUMMARY OF THE INVENTION

It is therefore an object of the present invention to provide a putter having a shaft alignment which may be adjusted only within the ranges proscribed by the U.S.G.A.

It is a further object of the present invention to provide a putter having a connection point between the shaft and the head which may be adjusted along the heel-to-toe axis so that the "balance" of the putter may be adjusted.

It is an additional object of the invention to provide a putter having alignment and balance adjustability but which also complies with all U.S.G.A. rules relating the design of clubs.

It is a further object of the invention to provide an adjustable putter wherein adjustment cannot be readily made during a round of golf, and wherein all adjustable parts are firmly fixed such that there is no reasonable likelihood of them working loose during a round.

Therefore, it would also be desirable to provide a putter having the aforementioned adjustability but which also complies with all U.S.G.A. rules relating the design of clubs.

These and other objects of the present invention are achieved by providing a golf putter having alignment and balance adjustability. The adjustable putter comprises a club head having a ball striking surface, a heel, a toe, a sole, a top surface, and a heel-to-toe axis. A shaft having a grip end and a connection end is connected to the head at a connection point along the heel-to-toe axis.

The connection means comprises a slide fixed to the connection end of the shaft and an elongate socket in the top surface of the club head. The socket has an axis that extends along or is parallel to the heel-to-toe axis. The slide orients the shaft at a heel-to-toe alignment angle of 10 degrees or greater from vertical.

A guide for guiding movement of the slide may be provided in the socket. The guide preferably comprises a cylindrical rod fixed in the socket at opposed ends and extending along the central axis of the socket and has a shape complimentary with the slide.

The slide is preferably a cylindrical segment having a hollow, cylindrical inner surface with a diameter greater than or equal to the diameter of the cylindrical rod. Clamping means prevent linear or rotational movement of said slide in said socket.

The adjustable putter also includes balance adjustment means for adjusting the connection point of the club head in infinite increments along the heel-to-toe axis of the club to adjust the balance of the club head.

The adjustable putter further includes alignment adjustment means for adjusting the line-of-play alignment angle of the shaft in infinite increments.

The club head comprises a first piece and a second piece forming a two-piece, interlocking construction. Each piece has a groove formed on opposed mating surfaces along the heel-to-toe axis. The socket is formed by the grooves when the first and second pieces are interlocked.

The club head also has means for interlocking the first and second pieces forming the club head and the socket. The socket has a diameter equal to or smaller than the diameter of the slide when the interlocking means are tightened fully without the slide being located in the socket.

The connecting means includes a stop for limiting adjustment of the line-of-play alignment angle of the shaft to plus or minus 20 degrees. The stop comprises opposed walls defining a slot formed in the top surface of the club head along or parallel to the axis of the socket.

In another embodiment, the adjustable golf club has a one piece head and a two a two-piece slide. The first piece comprises a cylindrical segment fixed the connection end of the shaft. The second piece comprises an elongate cylindrical segment having a shape which compliments the shape of the slot. The first piece and said second piece are constructed and arranged to interconnect at different angles relative to one another.

The first piece has protruding ribs on one end. The second piece has a linear slot on each end surface. The slots are oriented transverse to one another.

The first piece has a central, axial bore, while the second piece has a central, axial, threaded bore. The bores are coaxial when the first and second pieces are interconnected. A threaded connector is inserted through the bores of the first and second pieces to securely interconnect the pieces.

The adjustable golf club includes clamping means for preventing linear or rotational movement of the slide in the socket. The clamping means preferably comprises a threaded bore extending through the club head from the sole to the bottom portion of the slot, and a set screw inserted through the bore.

The slide preferably has a linear series of shallow apertures which extend along the bottom surface of the slide. The apertures are constructed and arranged to receive the end of the set screw.

The adjustable golf club also preferably includes a series of indicators on the top surface of the slide corresponding in axial location to one of the shallow apertures.

DESCRIPTION OF A PREFERRED EMBODIMENT OF THE INVENTION

Figure 1:
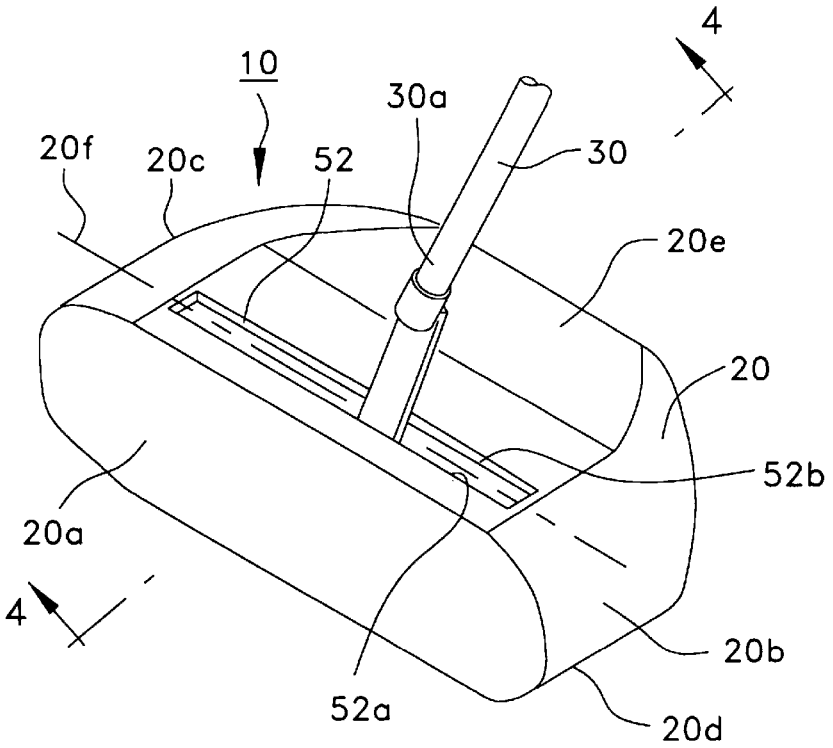
FIG. 1 is a perspective view of an embodiment of a putter head and connection end of a shaft of the present invention.

The adjustable putter and method of putting according to preferred embodiments of the present invention are described with reference to FIGS. 1–13 wherein like reference numerals represent similar features of each illustrated embodiment. The drawings are provided for illustrative purposes only and are not meant to limit the scope of the present invention.

The adjustable golf putter 10 according to a preferred embodiment of the invention has a head 20 and an elongate shaft 30 as seen in FIGS. 1–5. Referring to FIG. 1, the head 20 has a ball striking surface 20*a,* a heel 20*b,* a toe 20*c,* a sole 20*d,* and top surface 20*e.* A heel-to-toe axis 20*f* runs from the heel to toe of the club.

Figure 3:
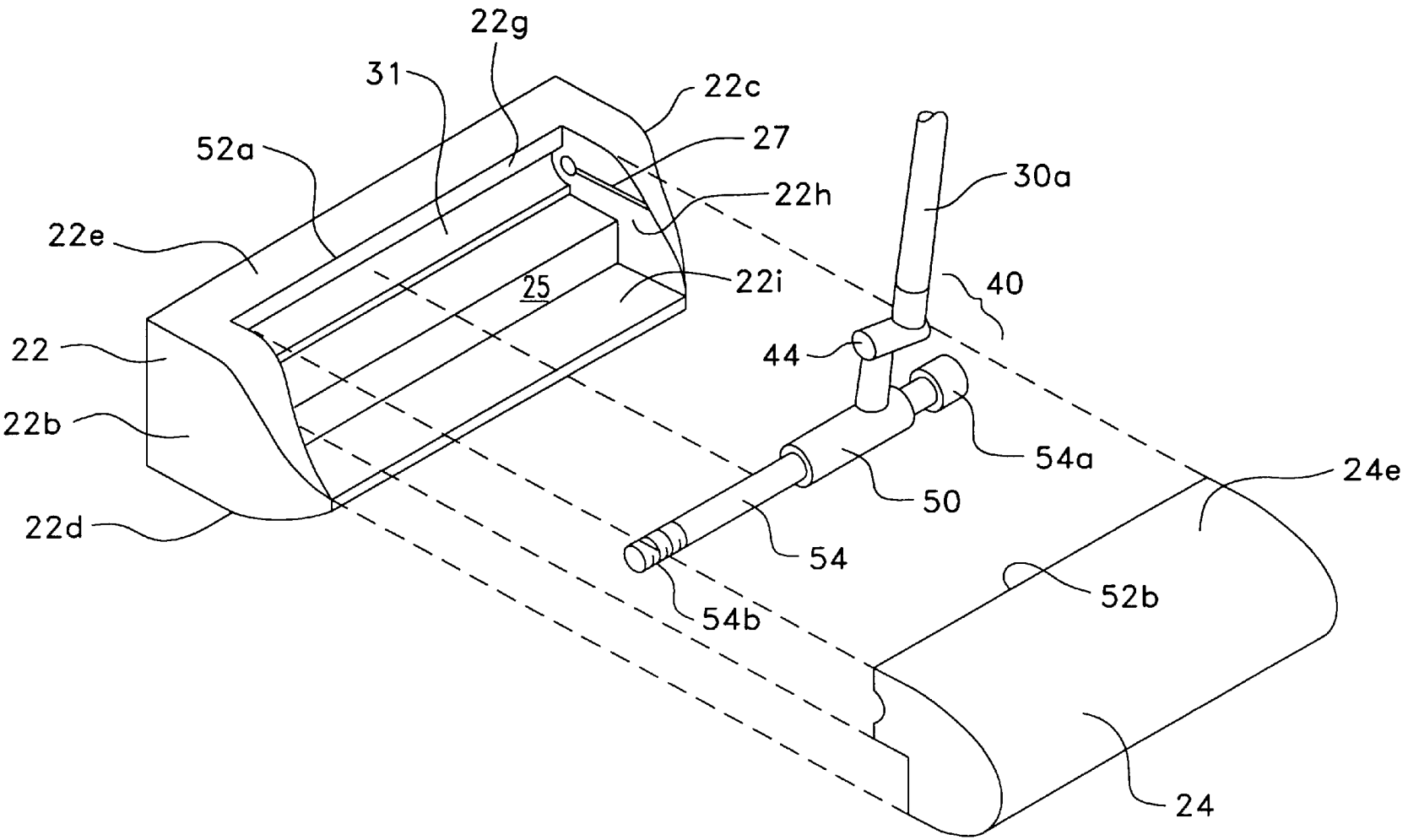
FIG. 3 is an exploded assembly view of a putter head and connection end of a shaft of the present invention.

The connection end 30*a* of the shaft 30 is connected to the club head 20 at a connection point along the heel-to-toe axis by connecting means, designated generally as reference numeral 40 as seen in FIG. 3. The shaft forms "heel-to-toe" alignment angle relative to the club head, graphically illustrated as angle "Y" in FIG. 5. The shaft also forms a "line-of-play" alignment angle relative to the club head, graphically illustrated as angle "X" in FIG. 4.

Figure 2:
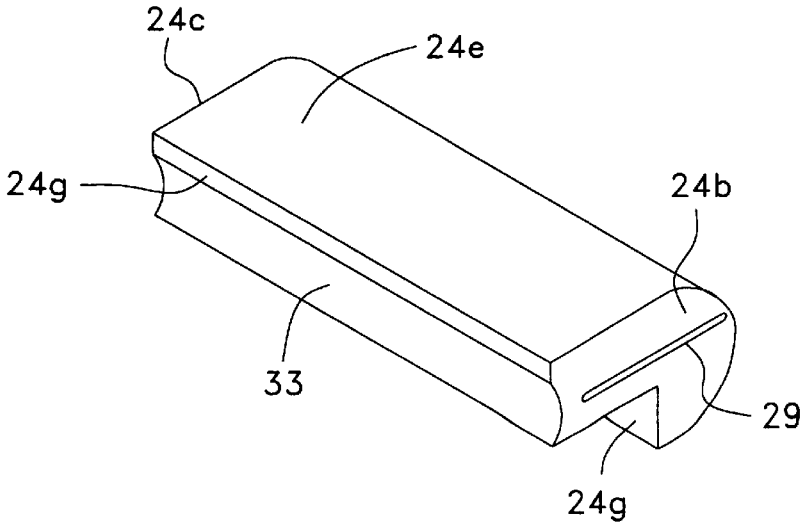
FIG. 2 is a perspective view of the back or second piece of the putter head of an embodiment of the invention.
Figure 4:
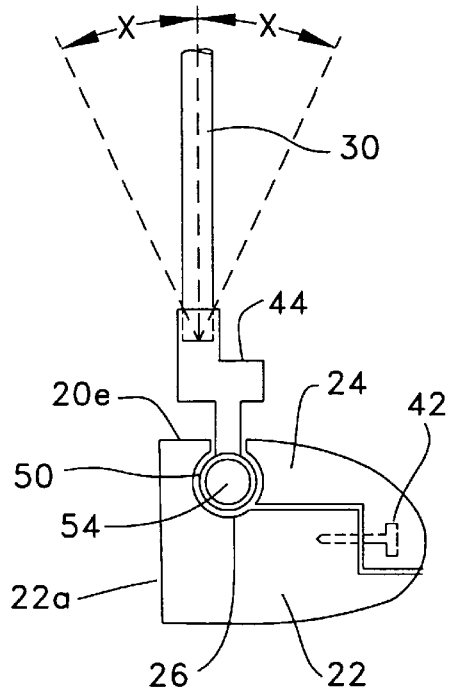
FIG. 4 is a cross-section taken along lines 4—4 of the putter head shown in FIG. 1.

The club head 20 has a two-piece 22, 24 interlocking construction. Referring to FIGS. 2–4, the first piece 22 has a generally flat front which forms the ball striking surface 22*a* of the club head. The first piece 22 has a top surface 20*e* which, together with the top surface 24*e* of the second piece 24, forms the top surface of the club head 20*e.* The first piece 22 has a bottom surface 22*d,* which forms the sole 20*d* of the club head, and two side surfaces 20*b,* 20*c* extending rearwardly from the front striking surface 20*a* to an irregularly-shaped, stepped rear surface.

Referring to FIG. 3, a cavity 25 is formed in the rear surface of the first piece 22 into which the second piece 24 inserts and interlocks. The cavity 25 is formed by an end surface 22*g,* two opposed side surfaces 22*h,* and a bottom surface 22*i.* The end surface 22*g* extends generally parallel to the front surface 22*a* and generally parallel to the heel-to-toe axis 20*f.* The two side surfaces 22*h* extend from front to back generally perpendicular to the heel-to-toe axis 20*f.*

Each side surface 22*h* has a protruding rib 27 which extends generally perpendicular to the heel-to-toe axis. The opposed ribs 27 cooperate with a pair of opposed, linerly extending recesses 29 on the second piece 24. To interlock the first piece 22 and second piece 24, the ribs 27 insertably slide into the recesses 29 to assist in locking the two pieces 22, 24 together.

An elongate groove 31 having a semi-circular cross-section is formed in the end surface 22*g* of the first piece 22. The groove 31 extends along the width of the cavity 25. The groove 31 cooperates with a similar, opposed groove 33 formed in the mating surface 24*g* of the second piece 24 to form a generally cylindrical socket 26. As described below, the socket 26 houses a slide 50 which is linearly and rotatably movable in the socket to adjust the alignment and balance of the adjustable golf putter.

The second piece 24 has a top surface 24*e* which, together with the top surface 22*e* of the first piece 22, forms the top surface 20*e* of the club head 20. The second piece has an irregularly-shaped, stepped front surface 24*g* which shape compliments the irregularly-shaped, stepped rear surface of the first piece 22 including the end surface 22*g* and bottom surface 22*i* of the cavity of the first piece 22. Two side surfaces 24*b,* 24*c* extend rearwardly from the front surface 24*g* to the rear surface which, together with the rear surface of the front piece, form the rear surface of the club head.

An elongate groove 33 having a semi-circular cross-section is formed in the front surface 24*g* of the second piece 24. The groove 33 extends along the width of the front surface 24*g*. The groove 33 cooperates with a similar, opposed groove 31 formed in the end surface 24*g* of the first piece 22 to form a generally cylindrical socket 26. As described below, the socket 26 houses a slide 50 which is linearly and rotatably movable in the socket 26 to adjust the alignment and balance of the adjustable golf putter.

The club head has means for interlocking the first 22 and second 24 pieces which form the head 20 including the socket 26. The socket 26 has a diameter equal to or smaller than the diameter of the slide 50 when the interlocking means are tightened fully without the slide 50 being located in the socket 26.

As described above, the ribs 27 in the first piece 22 slidably engage the recesses 29 in the second piece 24 to hold the two pieces 22 and 24 together. To further prevent the two pieces from sliding apart, a set screw 42 is inserted through an aperture in the second piece 24 and into a threaded bore in the rear surface of the first piece 22 as best seen in FIG. 4.

The putter has connecting means 40 to connect the club head 20 to the connection end 30*a* of the shaft 30. The connecting means 40 is designed so that the alignment angle and the balance of the putter can be adjusted when the interlocking means is untightened.

The shaft 30 has a hosel 44 fixed to the connection end 30*a* of the shaft 30. Referring to FIG. 3, the hosel 44 includes a socket 46 at one end into which the connection end 30*a* of the shaft 30 is inserted and secured. The other end of the hosel 44 has a slide 50 which is designed to slide in the socket 26 formed between the first 22 and second 24 pieces of the club head.

In a preferred embodiment, the slide comprises a hollow, cylindrical segment 50 fixed to the hosel 44 at an intermediate point along the lengthwise outer surface of the cylindrical segment 50. The length of the slide 50 is shorter than the length of the socket 26 and the diameter of the segment 50 is preferably slightly greater than or equal to the diameter of the socket 26. With this configuration, the slide 50 can be moved linearly in infinite increments along the socket 26 to adjust the balance of the club, and rotated in infinite increments in the socket to adjust the line-of-play alignment angle of the club, when the first 22 and second 24 pieces are not fully tightened. However, when the first 22 and second 24 pieces are fully tightened, linear and rotational movement of the slide 50 in the socket 26 are prevented, thereby locking the balance and line-of-play alignment angle selected by the golfer.

Figure 5:
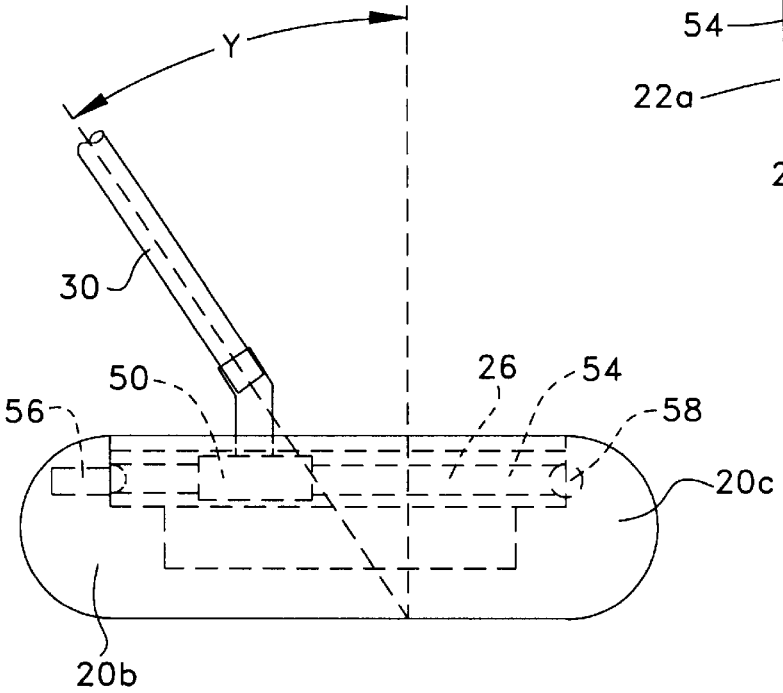
FIG. 5 is a front elevation of the putter head shown in FIG. 1, except that the putter head has been adapted to be used by a lefthanded golfer.

The cylindrical segment 50 is fixed to the hosel at an angle as seen in FIG. 5. This angle determines the heel-to-toe alignment angle "Y" of the putter as seen in FIG. 5. To conform with U.S.G.A. rules, the heel-to-toe angle "Y" is at least 10 degrees. Preferably, the heel-to-toe "Y" is slightly greater than 10 degrees.

When the first 22 and second 24 pieces are fully tightened, the mating surfaces 22*g* and 24*g* near the top surface 20*e* of the head 20 do not contact one another but rather form a slot 52 in the top surface of the club head along or parallel to the axis of the socket 26 as best seen in FIG. 1. The slot has a widthwise dimension larger than the diameter of the hosel 44 but smaller than the diameter of the slide 50. The front 52*a* and back 52*b* walls of slot 52 act as a stop for limiting adjustment of the line-of-play alignment angle of the shaft to plus or minus 20 degrees.

The club head preferably has a guide for guiding movement of the slide 50 in the socket 26. The guide has a shape complimentary with said slide 50. Referring to FIGS. 3, and 5, preferably the guide comprises a cylindrical rod 54 having a diameter equal to or slightly smaller than the inner diameter of the cylindrical slide 50. The cylindrical rod 54 is secured at opposed ends in the socket 26 and extends along the central axis of the socket 26. The cylindrical rod 54 is preferably threaded on one end 54*a* and has a hex-head socket 54*b* formed in the other end 54*b*. To secure the rod 54 in place, the rod 54 is inserted through a countersunk aperture 56 in one side of the first piece 22 and into a threaded bore 58 in the other side of the first piece 22. The cylindrical rod 54 can be tightened by applying torque to the hex-head socket formed at one end 54*a*.

Figure 6:
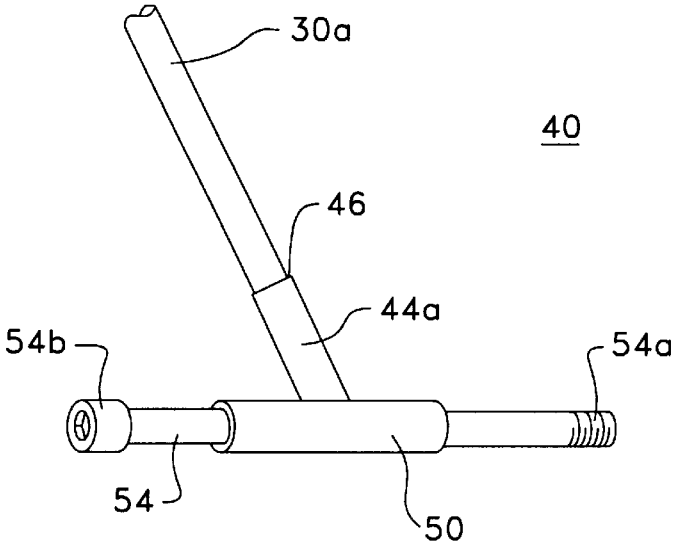
FIG. 6 is an enlarged perspective of an alternative hosel mounted on a slide.

FIG. 6 illustrates an alternative straight-on hosel 44*a*, which may be used in place of offset hosel 44 shown in FIGS. 1 and 3–5, having a slide 50 connected thereto and slidably mounted on rod 54.

Figure 7:
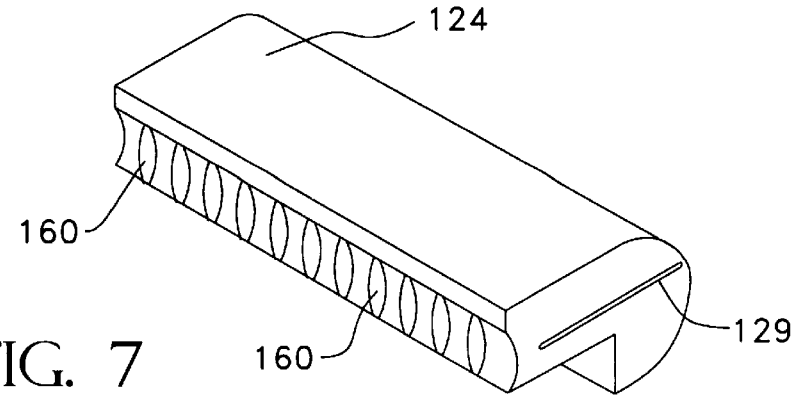
FIG. 7 is a perspective view of the back or second piece of the putter head of an alternative embodiment of the invention having a notched socket in the putter head.
Figure 8:
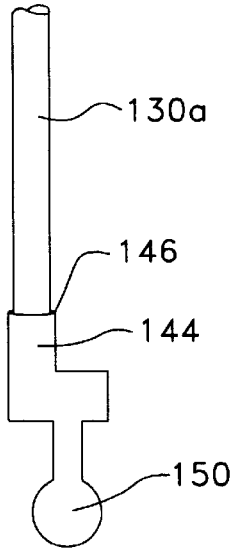
FIG. 8 is an enlarged perspective of a hosel and slide of another alternative embodiment of the invention.

In an alternative embodiment of the invention 110 illustrated in FIGS. 7 and 8, the slide comprises a sphere 150 fixed to a hosel 144. In this embodiment, the diameter of the sphere is equal to or slightly larger than the diameter of the socket 126 so that the sphere is linearly and rotationally movable in the socket 126 when the interlocking means are untightened, but is not movable when the interlocking means are tightened.

In this embodiment, the socket 126 does not have a guide 54 but may have regularly-spaced notches 160 into which the sphere 150 may be located to provide predetermined incremental adjustment of the sphere along the socket 126.

Figure 9:
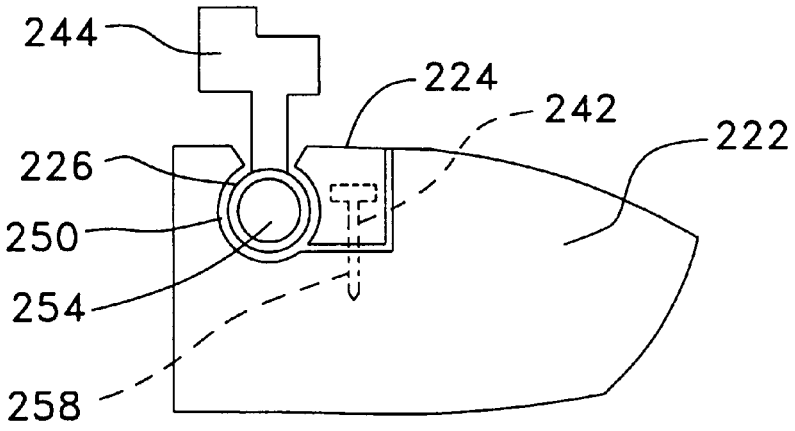
FIG. 9 is a cross-section of a putter head of another alternative embodiment of the invention.
Figure 10:
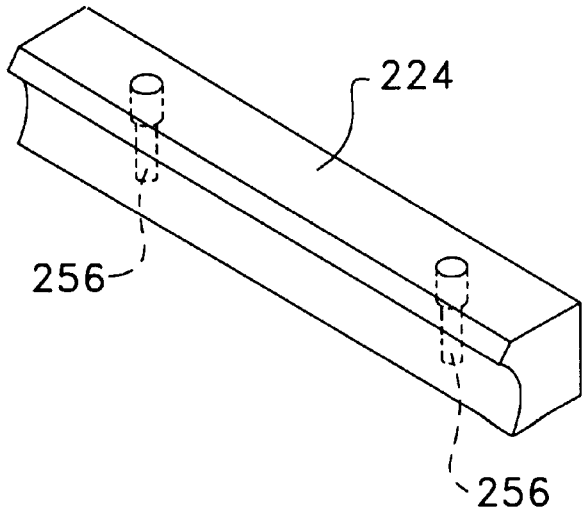
FIG. 10 is a perspective view of the back or record piece of the putter head shown in FIG. 9.

In another alternative embodiment of the invention illustrated in FIGS. 9 and 10, the slide comprises a hollow, cylindrical segment 250 affixed to a hosel 244 at an intermediate point along the lengthwise outer surface of the segment 250. The second piece 224 of the head comprises an elongate, irregularly-shaped bar as best seen in FIG. 10. The bar 224 cooperates with the first piece 222 to form a socket 226 into which the slide 250 is inserted and secured.

The club head of the embodiment shown in FIGS. 9 and 10 has means for interlocking the first 222 and second 224 pieces which form the head including the socket 226. To interlock the first 222 and second 224 pieces, set screws 242 are inserted through countersunk apertures 256 in the second piece and into threaded bores 258 in the first piece 222.

In another alternative embodiment, the slide illustrated in FIG. 9 comprises a sphere such as illustrated in FIG. 8. In this embodiment, the second piece 224 preferably includes regularly-spaced notches along its length into which the sphere may be located to provide predetermined incremental adjustment of the sphere along the socket.

In another alternative embodiment, the embodiments of the putters described above may be reversible to accommodate either a left or right handed golfer. Referring to FIGS. 1 and 3, the head of the club is symmetrical about an axis extending along the line of play, i.e., perpendicular to the heel-to-toe axis 20*f*. Therefore, the heel 20*b* and toe 20*c* of the head are defined above relative to the heel-to-toe alignment angle of the shaft. If, however, the shaft is removed from the head by disassembling the first and second pieces of the head, the shaft can be reaffixed to the head in a reverse orientation.

Referring to FIG. 1, the heel 20*b* and toe 20*c* are shown on a putter having the shaft assembled for use by a right-handed golfer. However, the shaft can also be assembled for use by a left-handed golfer as seen in FIG. 3 and 5 by rotating the shaft 180 degrees about the lengthwise axis of the shaft. When the hosel and shaft are rotated 180 degrees and reassembled to the head, the heel and toe are reversed and redefined accordingly.

In the method of the present invention, the adjustable golf club substantially as described above is provided to a golfer. The golfer adjusts the balance of the golf club and the line-of-play alignment angle of the golf club by first untightening the means for interlocking the first 22, 122, 222 and second 24, 124, 224 pieces which form the club head. The interlocking means may be loosened to merely adjust the balance and/or line-of-play alignment angle of the club, or may be removed completely to reverse the orientation of the connecting means to change the club from a left-handed orientation to a right-handed orientation, and visa-versa. The balance of the club is adjusted by linearly moving the slide 50, 150, 250 forward or backward in the socket 26 until the desired balance is obtained. The line-of-play alignment angle of the shaft of the golf club is adjusted by rotating the slide 50, 150, 250 in the socket until the desired line-of-play alignment angle is achieved. After the club head is adjusted as desired by the golfer, the interlocking means are then tightened to secure the club in the desired adjusted position. The golfer may then putt golf balls throughout a round of golf without deviation from the desired adjusted position.

Figure 11:
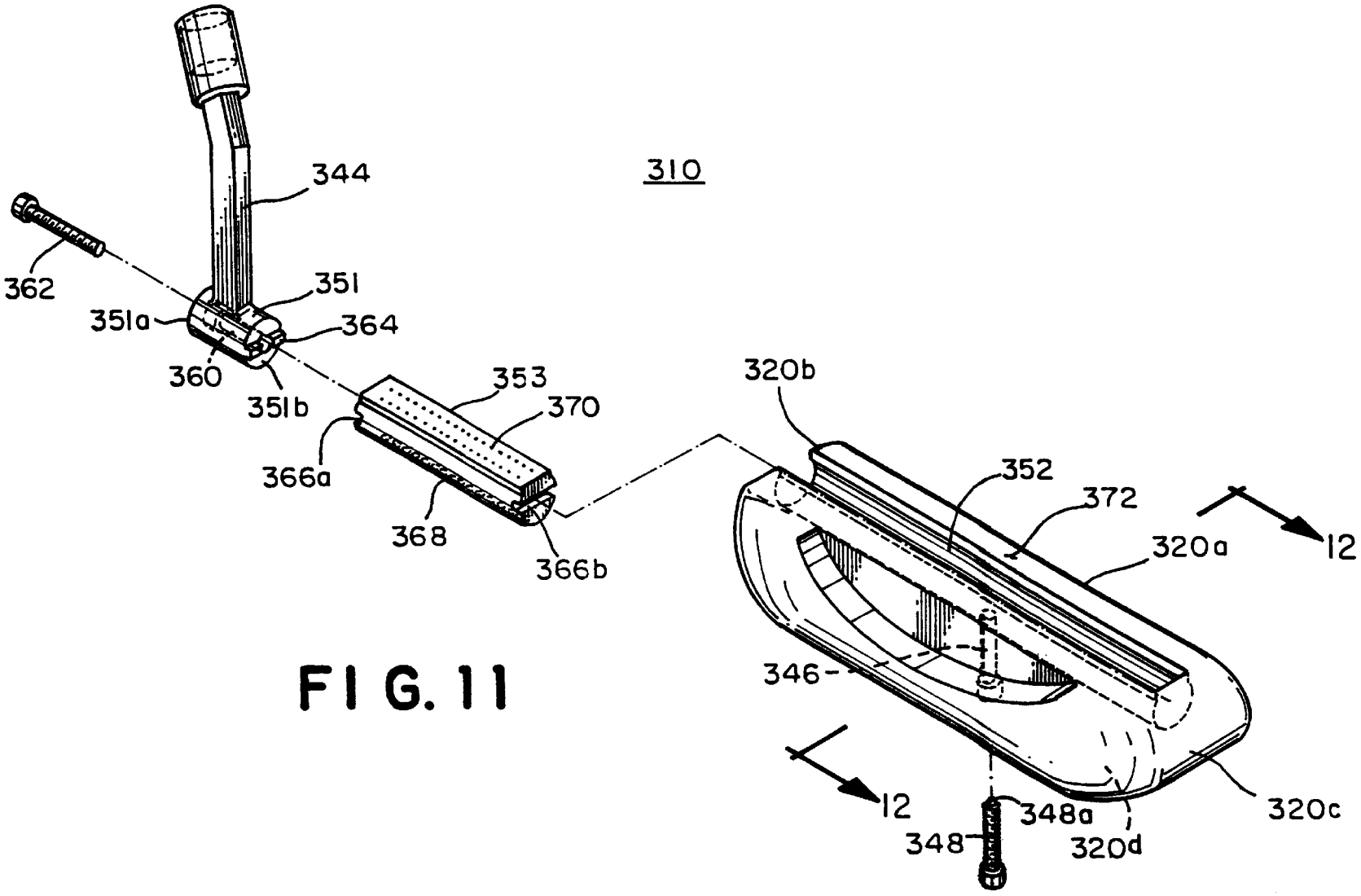
FIG. 11 is an exploded assembly view of a putter head and connection end of a shaft in accordance with a further embodiment of the invention.
Figure 12:
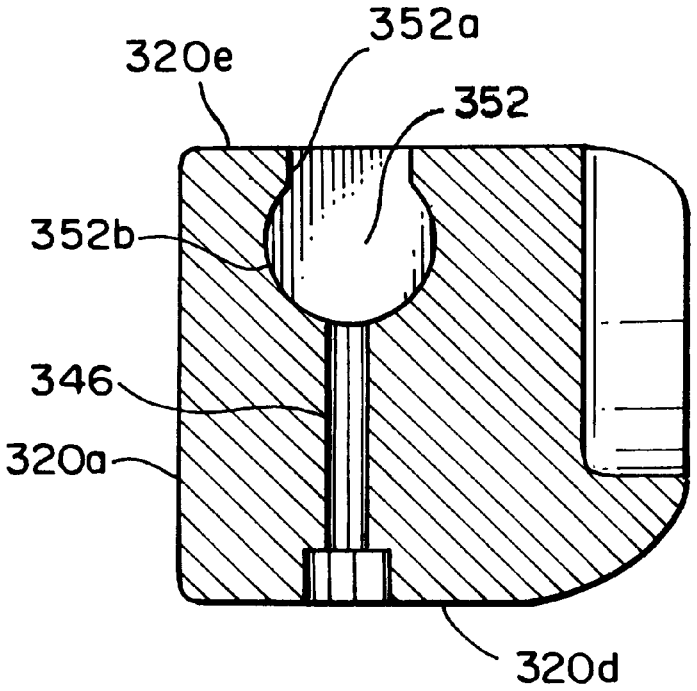
FIG. 12 is a cross-section of the putter head of FIG. 11 taken along lines 11—11 of FIG. 11; and, FIG. 13 is a side elevation of the second piece (353) of the slide shown in FIG. 11.
Figure 13:
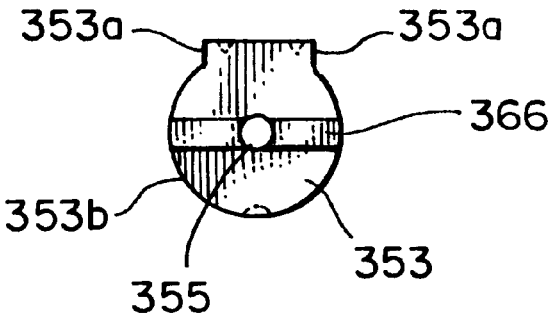

A further embodiment of the putter of the present invention is illustrated in FIGS. 11–13. The golf putter illustrated in FIGS. 11–13 is constructed in such a manner that adjustment cannot be readily made during a round of golf and all adjustable parts are firmly fixed such that there is no reasonable likelihood than any part will become loose during a round of golf. The golf putter embodiments illustrated in FIGS. 1–10 also comply with U.S.G.A. Rule 4-1a(i) and (ii) which states that a putter may be adjustable provided that the adjustment cannot be readily made and that all adjustable parts are firmly fixed and there is no reasonable likelihood of them working loose during a round. However, the putter embodiment illustrated in FIGS. 11–13 has an improved design which ensures that the balance and alignment angle are not likely to become altered during the course of play. The embodiment illustrated in FIGS. 11–13 also has a design which is easier to manufacture than the embodiments illustrated in FIGS. 1–10.

The adjustable golf putter 310 according to this embodiment of the invention has a one-piece club head 320 which has a ball striking surface 320*a,* a heel 320*b,* a toe 320*c,* a sole 320*d,* and a top surface 320*e.* A heel-to-toe axis runs from the heel to the toe of the club.

An elongate slot 352 having an irregularly-shaped cross-section is formed in the top surface of the club 320. Referring to FIG. 12, the cross-section is generally circular but has a squared top portion. The top of the slot 352 has flat side walls 352*a* which act as stops to prevent rotational movement of the slide within the slot 352. The slot originates at the heel, and extends along the heel-to-toe axis generally along the entire length of the club head 320.

Similar to the embodiments described above, the slot 352 is constructed to receive a slide 350 which is attached to the end of the hosel 344. The circular portion of the slot 352 has a diameter slightly larger than the diameter of the slide 350 so that the slide can be freely linearly moved within the slot 352 to adjust the balance of the putter. The width of the slot 352 at the side walls 352*a* is slightly larger than the rectangular-shaped, top portion of the slide and wider than the hosel 344. The cross sectional profile of the slot 352 is illustrated in FIG. 12.

The club head 320 further includes a threaded, cylindrical bore 346 extending from the sole 320*d* to an intermediate point at the bottom of the elongate slot 352. The threaded bore 346 is constructed and arranged to receive a set screw 348 which impinges on the bottom surface of the slide 350 to secure the slide 350 at a fixed location within the slot 352.

As described above and best seen in FIG. 11, the slide 350 has a two-piece construction. The first piece 351 comprises a short (compared to the second piece 353) cylindrical segment attached to the bottom of the hosel 344 at a point intermediate the outer annular surface of the first piece 351. The first piece 351 of the slide 350 has a longitudinal bore 360 extending along its entire length and through the central axis of the first piece 351. The bore is constructed and arranged to receive a connection screw 362 which fastens the second piece 353 to the first piece 351.

The longitudinal bore 360 has a countersink at the heel end 351*a* of the first piece so that the head of the set screw may be inserted flush with the heel end 351*a* of the first piece 351.

The toe end 351*b* of the first piece 351 has two axially protruding ribs 364 which protrude from opposed sides of the longitudinal bore 360. The ribs 364 are constructed and arranged to be inserted into a slot 366 in either end of the second piece 352 of the slide 350, thereby preventing the first piece 351 of the slide from rotating relative to the second piece 353.

The second piece 353 of the slide 350 comprises a long (compared to the first piece 351) generally elongate cylindrical segment having a rectangular-shaped portion formed at the top. The rectangular-shaped portion has side walls 353*a* which contact the side walls 352*a* of the slot 352 when the slide is inserted into the slot 352. The bottom portion of the second piece 353 has a generally cylindrical outer surface 353*b* which contacts the bottom cylindrical portion 352*b* of the slot 352 when the slide is inserted into the slot.

The second piece 353 has a first slot 366*a* and a second slot 366*b* formed in respective opposed end surfaces of the second piece 353. The slots 366 traverse each end surface of the second piece along the diameter of the end surfaces. The slots 366*a* and 366*b,* however, are not parallel to one another. Rather, one slot is oriented transverse to the other so that the angle at which the second piece 353 is attached to the first piece 351 may be changed or adjusted by the player. This allows the line-of-play alignment angle to be adjusted to two different positions by the golfer.

The putter may be provided with a plurality of second pieces which have the same construction as the second piece 353 illustrated in FIGS. 11 and 12, but which have slots which are oriented at a wide variety of different angles. The golfer may then adjust the line-of-play alignment angle to "N" different positions where "N" equals 2 times the number of second pieces provided with the putter.

The second piece 353 has an elongate, threaded bore 355 extending along the entire length of the central axis of the second piece 353. The threaded bore 355 is coaxial with the bore 360 of the first piece 351 so that the connection screw 362 can be inserted through the bores of both the first piece 351 and second piece 353, and securely connect the first 351 and second 353 pieces.

The second piece 353 has at least one linear series of shallow apertures 368 which extend along the bottom face of the slide. The apertures 368 receive the narrowly tapered end 348*a* of the set screw 348 so that the slide is prevented from moving within the slot 352. The slide also includes a series of indicators 370 on the top surface of the slide corresponding in axially location to one of the shallow apertures 368 on the bottom surface of the slide 350*a*. The indicators 370 assist the user in aligning the set screw with one of the shallow apertures 368 by aligning one of the indicators 370 on the slide with a reference indicator 372 on the top surface of the club head 320.

It will be apparent to those skilled in the art that the invention disclosed herein may be embodied in other specific forms without departing from the spirit and scope thereof. Accordingly, the disclosure of the present invention is intended to be illustrative, but not limiting of the scope of the invention that is set out in the following claims.

We claim:

1. An adjustable golf club comprising:

A) a club head having a ball striking surface, a heel, a toe, a sole, a top surface, and a heel-to-toe axis;

B) a shaft having a grip end and a connection end;

C) means for connecting the shaft to the club head at a connection point along the heel-to-toe axis and at a line-of-play alignment angle and a heel-to-toe alignment angle, said connecting means comprising a slide fixed to the connection end of said shaft and an elongate socket in a top portion of said club head, said socket having an axis that extends along or is parallel to the heel-to-toe axis, said slide having an outer surface profile that compliments said socket, said slide being removable from said socket;

D) balance adjustment means for adjusting the connection point of the club head along the heel-to-toe axis of the club to adjust the balance of the club head;

E) alignment adjustment means for adjusting the line-of-play alignment angle of the shaft; and, F) means for preventing adjustment of the line-of play alignment angle when said slide is inserted into said socket so that the line-of-play alignment angle can not be adjusted when said slide is inserted into said socket.

2. The adjustable golf club recited in claim 1, said connecting means comprising a slide fixed to the connection end of said shaft and an elongate socket in the top portion of said club head, said socket having an axis that extends along or is parallel to the heel-to-toe axis.

3. The adjustable golf club recited in claim 2, said socket and slide having complimentary shapes.

4. The adjustable golf club recited in claim 3, said slide comprising a hosel with a protruding cylindrical segment fixed to the connection end of said shaft, and a substantially cylindrical socket in the top portion of said club head, said socket having a length greater than the length of said cylindrical segment and a central axis that extends along or is parallel to the heel-to-toe axis.

5. The adjustable golf club recited in claim 4 including a guide for guiding movement of said slide in said socket.

6. The adjustable golf club recited in claim 5, said guide comprising a cylindrical rod fixed in said socket at opposed ends and extending along the central axis of said socket, said guide having a shape complimentary with said slide.

7. The adjustable golf club recited in claim 6, said cylindrical segment having a hollow, cylindrical inner surface with a diameter greater than or equal to the diameter of the cylindrical rod.

8. The adjustable golf club recited in claim 2, said shaft having a hosel with a protruding sphere fixed to the connection end of said shaft and a substantially cylindrical socket in the top portion of said club head, said socket having a length greater than the diameter of said sphere and a central axis that extends along or is parallel to the heel-to-toe axis.

9. The adjustable golf club recited in claim 2, said connecting means including clamping means for preventing linear or rotational movement of said slide in said socket.

10. The adjustable golf club recited in claim 2, said club head comprising a first piece and a second piece forming a two-piece, interlocking construction, each piece having a groove formed on opposed mating surfaces along the heel-to-toe axis, said socket being formed by said grooves when said first and second pieces are interlocked.

11. The adjustable golf club recited in claim 10, including means for interlocking said first and second pieces forming said socket, said socket having a diameter equal to or smaller than the diameter of said slide when said interlocking means are tightened fully without said slide being located in the socket.

12. The adjustable golf club recited in claim 2, said socket including a lengthwise slot formed in the top surface of the club head along or parallel to the axis of said socket, said slot having a widthwise dimension larger than the diameter of the connecting end of said shaft but smaller than the diameter of said slide.

13. The adjustable golf club recited in claim 2, said connecting means including a stop for limiting adjustment of the line-of-play alignment angle of the shaft to plus or minus 20 degrees.

14. The adjustable golf club recited in claim 13, said stop comprising a slot formed in the top surface of the club head along or parallel to the axis of the socket.

15. The adjustable golf club recited in claim 2, said slide orienting said shaft at a heel-to-toe alignment angle of 10 degrees or greater.

16. The adjustable golf club recited in claim 1, said connecting means, balance adjustment means, and alignment adjustment means comprising a slide fixed to the connection end of said shaft and an elongate socket in the top portion of said club head, said socket having an axis that extends along or is parallel to the heel-to-toe axis.

17. An adjustable golf club comprising:

A) a club head having a ball striking surface, a heel, a toe, a sole, a top surface, and a heel-to-toe axis;

B) a shaft having a grip end and a connection end;

C) means for connecting the shaft to the club head at a connection point along the heel-to-toe axis and at a line-of-play alignment angle and a heel-to-toe alignment angle, said connecting means comprising a slide fixed to the connection end of said shaft and an elongate socket in a top portion of said club head, said socket having an axis that extends along or is parallel to the heel-to-toe axis, said slide having an outer surface profile that compliments said socket, said slide being removable from said socket;

D) balance adjustment means for adjusting the connection point of the club head along the heel-to-toe axis of the club to adjust the balance of the club head;

E) alignment adjustment means for adjusting the line-of-play alignment angle of the shaft; and, F) means for preventing adjustment of the line-of-play alignment angle when said slide is inserted into said socket, the connecting means comprising a slide fixed to the connection end of said shaft and an elongate socket in the top portion of said club head, said socket having an axis that extends along or is parallel to the heel-to-toe axis, said socket and slide having complimentary shapes, said shaft having a hosel with a protruding cylindrical segment fixed to the connection end of said shaft, and a substantially cylindrical socket in the top portion of said club head, said socket having a length greater than the length of said cylindrical segment and a central axis that extends along or is parallel to the heel-to-toe axis, including a guide for guiding movement of said slide in said socket, said guide comprising a cylindrical rod fixed in said socket at opposed ends and extending along the central axis of said socket, said guide having a shape complimentary with said slide, said cylindrical segment having a hollow, cylindrical inner surface with a diameter greater than or equal to the diameter of the cylindrical rod, said connecting means further including clamping means for preventing linear or rotational movement of said slide in said socket, said club head comprising a first piece and a second piece forming a two-piece, interlocking construction, each piece having a groove formed on opposed mating surfaces along the heel-to-toe axis, said socket being formed by said grooves when said first and second pieces are interlocked, and further including means for interlocking said first and second pieces forming said socket, said socket having a diameter equal to or smaller than the diameter of said slide when said interlocking means are tightened fully without said slide being located in the socket, said socket including a lengthwise slot formed in the top surface of the club head along or parallel to the axis of said socket, said slot having a widthwise dimension larger than the diameter of the connection end of said shaft but smaller than the diameter of said slide, said connecting means further including a stop for limiting adjustment of the line-of-play alignment angle of the shaft to plus or minus 20 degrees, said stop comprising a slot formed in the top surface of the club head along or parallel to the axis of the socket, and said slide orienting said shaft at a heel-to-toe alignment angle of 10 degrees or greater.

18. A method of putting a golf ball comprising the steps of:

A) providing an adjustable golf club comprising:

1) a club head having a ball striking surface, a heel, a toe, a sole, a top surface, and a heel-to-toe axis;

2) a shaft having a grip end and a connection end;

3) means for connecting the shaft to the club head at a connection point along the heel-to-toe axis and at a line-of-play alignment angle, said connecting means comprising a slide fixed to the connection end of said shaft and an elongate socket in a top portion of said club head, said socket having an axis that extends along or is parallel to the heel-to-toe axis, said slide having an outer surface profile that compliments said socket, said slide being removable from said socket;

4) balance adjustment means for adjusting the connection point of the club head along the heel-to-toe axis of the club to adjust the balance of the club head;

5) alignment adjustment means for adjusting the line-of-play alignment angle of the shaft; and, 6) means for preventing adjustment of the line-of play alignment angle when said slide is inserted into said socket so that the line-of-play alignment angle can not be adjusted when said slide is inserted into said socket, B) removing said slide from said socket and adjusting the line-of-play alignment angle;

C) inserting the slide back into the socket to prevent the line-of-play angle from changing;

D) adjusting the balance of said golf club; and,

E) striking the golf ball with said club.

19. A reversible golf club comprising:

A) a club head having a ball striking surface, a heel, a toe, a sole, a top surface, and a heel-to-toe axis, and a line-of-play axis generally perpendicular to said heel-to-toe axis, said club head being symmetrical about said line-of-play axis;

B) a shaft having a grip end and a connection end;

C) means for connecting the shaft to the club head at an alignment angle along the heel-to-toe axis, said alignment angle being measured from the heel of the head; said connecting means comprising a slide fixed to the connection end of said shaft and an elongate socket in a top portion of said club head, said socket having an axis that extends along or is parallel to the heel-to-toe axis, said slide having an outer surface profile that compliments said socket, said slide being removable from said socket;

D) adjustment means for reversing the orientation of the club by reversing said shaft to said same alignment angle;

E) balance adjustment means for adjusting the connection point of the club head along the heel-to-toe axis of the club to adjust the balance of the club head;

F) alignment adjustment means for adjusting the line-of-play alignment angle of the shaft; and, G) means for preventing adjustment of the line-of-play alignment angle when said slide is inserted into said socket so that the line-of-play alignment angle can not be adjusted when said slide is inserted into said socket.

20. The reversible putter recited in claim 19, including:

E) balance adjustment means for adjusting the connection point of the club head in infinite increments along the heel-to-toe axis of the club to adjust the balance of the club head; and F) alignment adjustment means for adjusting the line-of-play alignment angle of the shaft in infinite increments.

21. The reversible golf club recited in claim 20, said connecting means comprising a slide fixed to the connection end of said shaft and an elongate socket in the top portion of said club head, said socket having an axis that extends along or is parallel to the heel-to-toe axis.

22. An adjustable golf club comprising:

A) a club head having a ball striking surface, a heel, a toe, a sole, a top surface, and a heel-to-toe axis;

B) a shaft having a grip end and a connection end;

C) means for connecting the shaft to the club head at a connection point along the heel-to-toe axis and at a line-of-play alignment angle and a heel-to-toe alignment angle;

D) balance adjustment means for adjusting the connection point of the club head along the heel-to-toe axis of the club to adjust the balance of the club head; and E) alignment adjustment means for adjusting the line-of-play alignment angle of the shaft, and F) means for limiting adjustment of the line-of-play alignment angle of said club within the ranges specified by the U.S.G.A. rules of golf, said connecting means comprising a slide fixed to the connection end of said shaft and an elongate socket in a top portion of said club head, said socket having an axis that extends along or is parallel to the heel-to-toe axis, said limiting means comprising a pair of stops in said socket for limiting adjustment of the line-of-play alignment angle of the shaft.

23. The adjustable golf club recited in claim 22, said alignment adjustment means comprising a two-piece slide, said first piece comprising a cylindrical segment fixed the connection end of said shaft, said second piece comprising an elongate cylindrical segment having a shape which compliments the shape of said slot.

24. The adjustable golf club recited in claim 23, said first piece and said second piece constructed and arranged to interconnect at different angles relative to one another.

25. The adjustable golf club recited in claim 24, said first piece having protruding ribs on one end, said second piece having a linear slot on each end surface, said slots being oriented transverse to one another.

26. The adjustable golf club recited in claim 25, said first piece having a central, axial bore, said second piece having a central, axial, threaded bore, said bores being coaxial when said first and second pieces are interconnected.

27. The adjustable golf club recited in claim 26, including a threaded connector inserted through the bores of said first and second pieces to securely interconnect said pieces.

28. The adjustable golf club recited in claim 27, including clamping means for preventing linear or rotational movement of said slide in said socket.

29. The adjustable golf club recited in claim 28, said clamping means comprising a threaded bore extending through said club head from the sole to the bottom portion of said slot, and a set screw inserted through said bore.

30. The adjustable golf club recited in claim 29, said slide having a linear series of shallow apertures which extend along the bottom surface of said slide, said apertures constructed and arranged to receive the end of said set screw.

31. The adjustable golf club recited in claim 30, including a series of indicators on the top surface of said slide corresponding in axial location to one of said shallow apertures.

32. The adjustable golf club recited in claim 24, including a plurality of second pieces, each second piece constructed and arranged to interconnect with said first piece at different angles compared to each of the other second pieces.

* * * * *